US007097173B2

(12) United States Patent
Spoorenberg et al.

(10) Patent No.: US 7,097,173 B2
(45) Date of Patent: Aug. 29, 2006

(54) POSITION DETECTOR

(75) Inventors: Christophorus Lambertus Spoorenberg, Venlo (NL); Hendrik Frederik Paul Bruggeling, Baarlo (NL); Roel Paul Marie Beeren, Horst (NL); Franciscus Johannes Hermanus Rothoff, Velden (NL)

(73) Assignee: Oće Technologies B.V., Venlo (NL)

( * ) Notice: Subject to any disclaimer, the term of this patent is extended or adjusted under 35 U.S.C. 154(b) by 606 days.

(21) Appl. No.: 10/400,472

(22) Filed: Mar. 28, 2003

(65) Prior Publication Data

US 2003/0227129 A1 Dec. 11, 2003

(30) Foreign Application Priority Data

Mar. 29, 2002 (EP) ..... 02076338

(51) Int. Cl.
*B65H 39/10* (2006.01)

(52) U.S. Cl. ..... 271/292; 270/58.19

(58) Field of Classification Search ..... 271/292; 270/58.19

See application file for complete search history.

(56) References Cited

U.S. PATENT DOCUMENTS 4,667,953 A 5/1987 Hirakawa et al.
5,104,366 A * 4/1992 Bunch ..... 493/23
5,270,733 A * 12/1993 Parsons et al. ..... 347/215
5,440,979 A * 8/1995 Bonham et al. ..... 101/91
6,318,718 B1 11/2001 Ogata et al.
6,378,860 B1 4/2002 Gutierrez et al.
2001/0054791 A1 12/2001 Goldback et al.

FOREIGN PATENT DOCUMENTS

| | | |
|---|---|---|
| DE | 42 07 305 C2 | 9/1996 |
| DE | 197 11 406 C1 | 10/1998 |
| EP | 0 798 246 A1 | 10/1997 |
| GB | 2 036 701 A | 7/1980 |
| JP | 58 119530 A | 7/1983 |

* cited by examiner

*Primary Examiner*—Donald P. Walsh
*Assistant Examiner*—Kenneth W Bower
(74) *Attorney, Agent, or Firm*—Birch, Stewart, Kolasch & Birch, LLP

(57) ABSTRACT

A sheet depositing device for a sheet processing apparatus, includes a feeding section for sequentially feeding sheets or sets of sheets from the sheet processing apparatus, at least one sheet stacking element movable along a guide, for facilitating depositing the sheets or sets of sheets fed by the feeding section, and a sensor arrangement for detecting the position of a sheet stacking element along the guide. The sensor arrangement includes a stationary linear array of active elements and a passive element moving in unison with the sheet stacking element. The active and passive elements are of a kind that interact through the use of electric or magnetic fields. Examples of such sensors are an array of conductive fields arranged in parallel to a conductive strip or a second array of conductive fields, and a conductive plate connected to a capacitance meter; and an array of Hall-effect sensors and a magnet.

16 Claims, 8 Drawing Sheets

POSITION DETECTOR

The present application claims, under 35 U.S.C. § 119, the foreign priority benefit of European Patent Application No. 02076338.9 filed Mar. 29, 2002.

BACKGROUND OF THE INVENTION

1. Field of the Invention

The present invention relates to a sheet depositing device for a sheet processing apparatus, comprising a feeding section for sequentially feeding sheets or sets of sheets from the sheet processing apparatus, at least one sheet stacking element movable along a guide, for facilitating the deposition of the sheets or sets of sheets fed by the feeding section in the sheet depositing device, and a sensor arrangement for detecting the position of a sheet stacking element along the guide, wherein the sensor arrangement includes a stationary linear array of active elements and a passive element moving in unison with the sheet stacking element.

2. Discussion of Background Art

An array of active sensors for determining a sheet stacking tray is known from U.S. Pat. No. 6,318,718 B1. This document is directed to a printer having a copy stacking tray that can be lowered to accommodate more sheets, and at the same time keeping the upper end of the sheet stack close to the sheet ejecting port of the print engine. Since the load of sheets on the tray increases with the tray position, the motor that moves the tray is provided with a gear box. A number of sensors are positioned along the path of the tray. When the tray passes one of the sensors, the gear ratio is adjusted for that position. However, the sensors are placed relatively far apart so that the arrangement is thus not suitable for a continuous tray position determination. No information as to the kind of sensors used is given.

U.S. Patent Application Publication No. US 2001/054791 A1 is directed to a printer in which the height of a sheet stack on a movable tray is determined by lowering a flat element onto the stack. In one embodiment, the exact position of the flat element is determined using a row of optical sensors.

Optical sensors have the advantage that they need no physical contact with the object they sense. However, a disadvantage of optical sensors is that they have an on/off behaviour, such that the resolution of the position determination is equal to the pitch of the optical sensors. If a high resolution is required, then many optical sensors must be mounted per mm, leading to high cost. Further, optical sensors are quite sensitive to dust pollution. In a sheet depositing device, dust, in the form of paper fibres, is omnipresent. Thus, sensor errors or failure are quite common when the optical sensors are used, the more so when small optical sensors are used to give a high resolution.

SUMMARY OF THE INVENTION

On this background, it is an object of the present invention to provide a sheet depositing device of the kind referred to initially, having a sensor arrangement which conveniently and reliably allows detection of the position of a plurality of sheet stacking elements, such as depositing platforms and sheet catchers.

It is another object of the present invention to provide a sheet depositing device including a sensor arrangement, which overcomes problems and limitations of the conventional art.

In accordance with an embodiment of the present invention, a sensor arrangement is provided wherein the active and passive elements are of a kind that interact through the use of electric or magnetic fields and wherein the active elements are positioned closely together in the array. This construction makes possible determining the position of the passive element at a higher resolution than the pitch of the active elements, because the passive element can be sensed by at least two active elements at a time and their readings can be interpolated.

A very basic form of interpolation would be to choose the position midway between two adjoining active elements, if both are activated by the passive element. A more sophisticated solution would be to calculate a weighted interpolation of the readings of the two adjoining active elements. Thus, in the present invention, less active elements per mm are required for a certain resolution, which brings down the cost, in addition to the fact that sensors as meant by the present invention are already cheaper than optical sensors of the related art.

Further, paper dust does not disturb measurements that rely on electric or magnetic fields, whereas the use of optical sensors does. By using an electric or magnetic sensor arrangement, the present invention provides a higher reliability and a higher measuring accuracy, so that the above-mentioned interpolation becomes also more reliable.

In a first embodiment of the present invention, the array of active elements comprises an array of conductive fields arranged in parallel to a conductive strip or a second array of conductive fields, and the passive element comprises a conductive plate. The measurement of this kind of sensor is based on the electrical capacity of the arrangement of a conductive field, the conductive plate and the conductive strip/array of fields. This is an extremely simple and cost-effective embodiment, which can easily be scaled down to give a high position resolution.

In a second embodiment of the present invention, the array of active elements comprises an array of Hall-effect sensors, and the passive element comprises a magnet. Hall sensors are inexpensive, relatively insensitive for dust and small enough to provide a good position resolution.

In a further embodiment of the device according to the invention, the array of active elements is affixed to the guide, or even, if possible, inside the guide, so that it is well protected from external influences. The array of active elements extends over the lifting height of the depositing platform, so that the position of the depositing tray is known over the entire lifting height.

The sheet depositing device according to the present invention may comprise one or more further superposed depositing platforms movable along the rail and a passive element moving in unison with the further depositing platforms. Thus, a plurality of stacks may be formed on the sheet depositing device, and a finished stack may be transported away while another one is being formed.

The sheet depositing device according to the present invention may also comprise one or more sheet catchers movable along the rail and a passive element moving in unison with the sheet catchers. By detecting the position of the sheet catchers, the stack height and thus the filling grade of the depositing platform is known.

Further objects, features, advantages and properties of the position detector according to the invention will become apparent from the detailed description.

BRIEF DESCRIPTION OF THE DRAWINGS

In the following detailed portion of the present description, the invention will be explained in more detail with reference to the exemplary embodiments shown in the drawings, in which.

DETAILED DESCRIPTION OF THE PREFERRED EMBODIMENTS

In the present invention, expediently, the sheet depositing device is located at the output of a paper processing machine. The sheet depositing device of the present invention will hereafter be illustrated with a paper processing machine in the form of a printing apparatus. It is evident that the sheet depositing device could be operated together with any other type of paper processing apparatus, such as copiers, imaging devices, etc.

Figure 1:
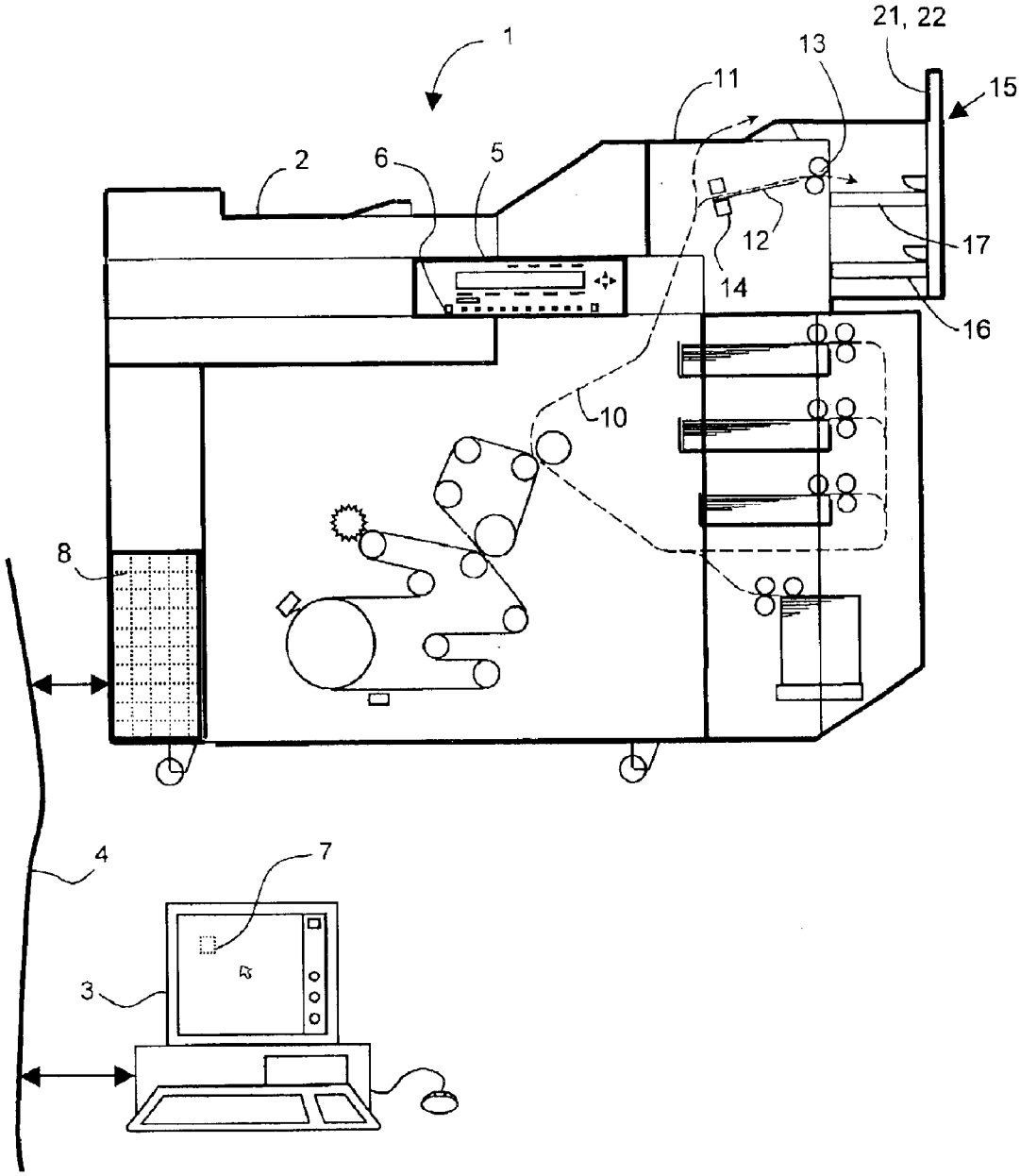
FIG. 1 illustrates one embodiment of a sheet depositing device in combination with a printing apparatus according to the present invention.

The printing apparatus 1 shown in FIG. 1 according to an embodiment of the present invention comprises means known for printing an image on a receiving sheet. These images for printing may be present on original documents which are fed to a scanning station 2 situated at the top of the printing apparatus 1. Images for printing can also be fed in digital form from a workstation 3 connected via a network 4 to a control device 8 of the printing apparatus 1. A printing cycle for copying an original set fed via the scanning station 2 is started by actuating a start button 6 or other designated item on the operator control panel 5 of the printing apparatus 1.

A printing cycle for printing an image set fed via the workstation 3 can be started by actuating a start button 7 or other designated item provided on the workstation 3 via the control device 8 or by actuating the start button 6 provided on the operator control panel 5 of the printing apparatus 1. The printing or other operations of the printing apparatus 1 may also be actuated by using voice-commands, remote controls, etc.

In the printing apparatus 1 shown in FIG. 1, a sheet transport path 10 forms the path for delivering to a sheet finishing station 11 the sheets printed in the printing apparatus 1.

The finishing station 11 contains a sheet collecting tray 12 (not shown in detail) in which a number of printed sheets belonging to a set can be collected and stapled by a stapler 14. Thereafter discharge roller pairs 13 feed the set to a sheet depositing device 15 forming part of a sheet depositing station.

Figure 2:
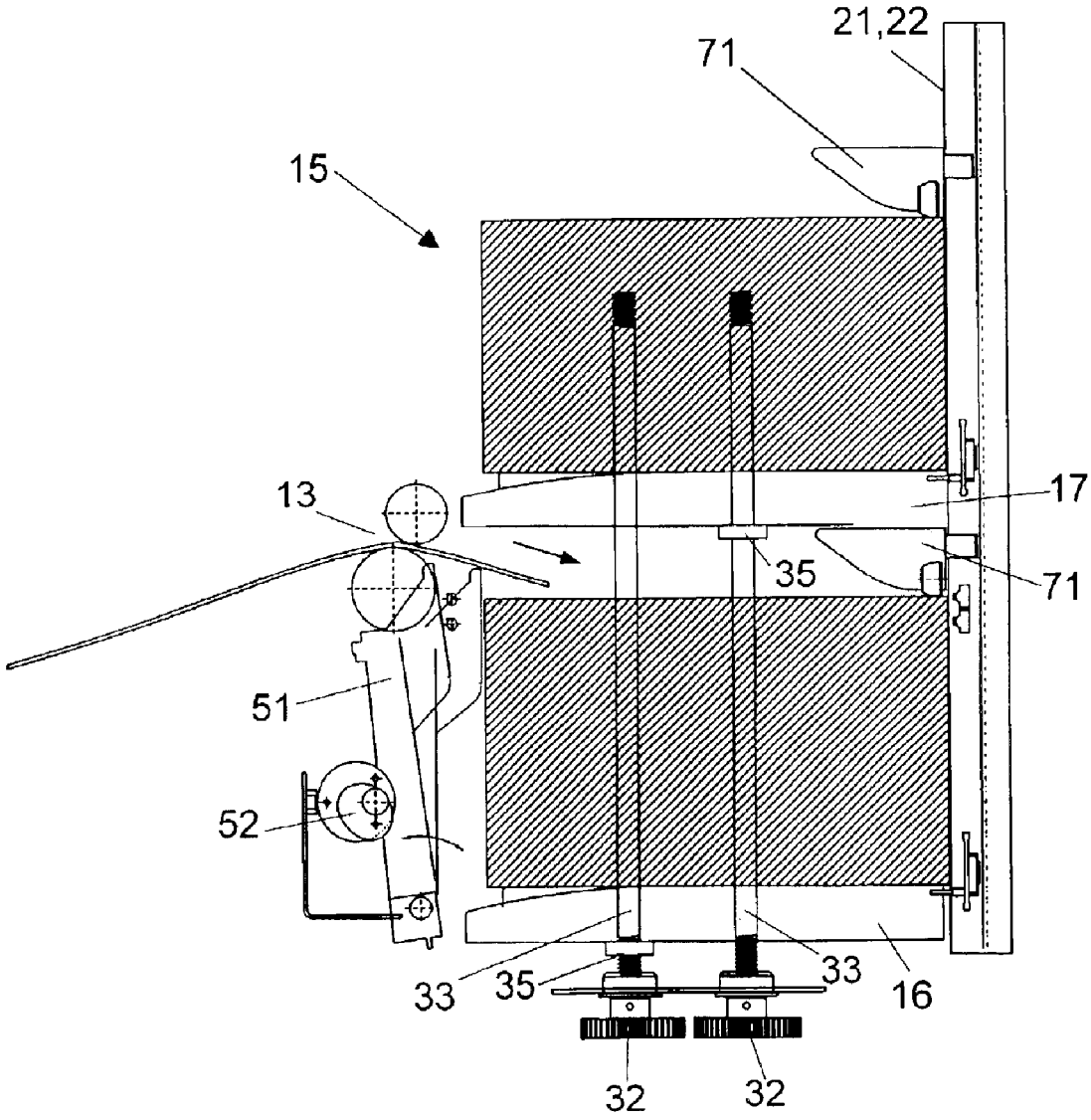
FIG. 2 is a detailed side view of the sheet depositing device in FIG. 1.

The sheet depositing device 15 shown in FIG. 2 according to an embodiment of the present invention comprises two superposed depositing platforms 16 and 17, upon which sheets are sequentially stacked. Obviously, in other examples, a different number of depositing platforms may be provided as needed. The depositing platforms 16 and 17 are guided along a pair of guide rails 21 and 22 in the form of two hollow aluminium profiles that serve also as a registration barrier for supplied sheets. Each of the depositing platforms 16 and 17 can be set to a depositing position with respect to the horizontal discharge path formed by the discharge roller pair 13, to receive sheets discharged by the discharge roller pair 13. Each depositing platform is provided with two sheet catchers 71 for preventing incoming sheets from bouncing back, as will be described later in connection with FIGS. 4 and 5. In other examples, one or a different number of sheet catchers may be provided for each depositing platform.

The vertical displacement of the depositing platforms 16 and 17 is effected by a spindle drive system associated with each depositing platform 16,17. Each spindle drive comprises a DC motor (not shown) driving a spindle-shaft 33 through a reduction gearing 32. The spindle-shafts 33 driving the depositing platforms 16 and 17 extend vertically next to the depositing platforms. A nut 35 translating the relative rotation of the spindle shaft 33 in a vertical movement embraces each spindle-shaft 33 threaded engagement. Each nut 35 carries the respective depositing platform 16,17.

The vertical position of the selected depositing platform 16,17 or the sheet at the top thereof, is generally always just beneath the discharge path formed by the discharge roller pair 13. FIG. 2 shows the lower depositing platform 16 in a bottom depositing position in which a number of sheets are situated on the depositing platform 16 and the depositing platform 17 thereabove is in a parking position situated above the discharge path formed by the discharge roller pair 13 to receiving the discharged sheets.

Since the depositing platform 17 is adjustable as to its height independently of the depositing platform 16, the depositing platform 17 can be placed in a depositing position without the lower depositing platform 16 needing to be moved further down than the bottom depositing position shown in FIG. 2.

As a result, the finishing station 11 with the sheet depositing device 15 adjacent thereto, is very suitable for disposing sheets (or other suitable means) at the top of the printing apparatus 1. The top of the printing apparatus 1 includes the scanning station 2 situated at a normal working height for a standing operator of about 100 cm or other suitable height. In the printing apparatus 1 with the finishing station 11 as shown in FIG. 1, the removal height for sheets deposited on the depositing platforms 16 and 17 is, in one example, between 100 cm and 160 cm for a total sheet depositing capacity of about 2400 sheets. The sheet depositing level defined by the fixed discharge rollers 13 is approximately 133 cm and this level corresponds to the depositing level at which the bottom depositing platform 16 is in its bottom depositing position.

A knocker 51 in FIG. 2 is provided to produce a smooth-sided stack of sheets by knocking the edges of the stack towards the registration barrier formed by the guide rails 21 and 22. An excenter mechanism 52 drives the knocker 51. The knocker 51 moves rapidly and if necessary repeatedly towards the stack.

Figure 3:
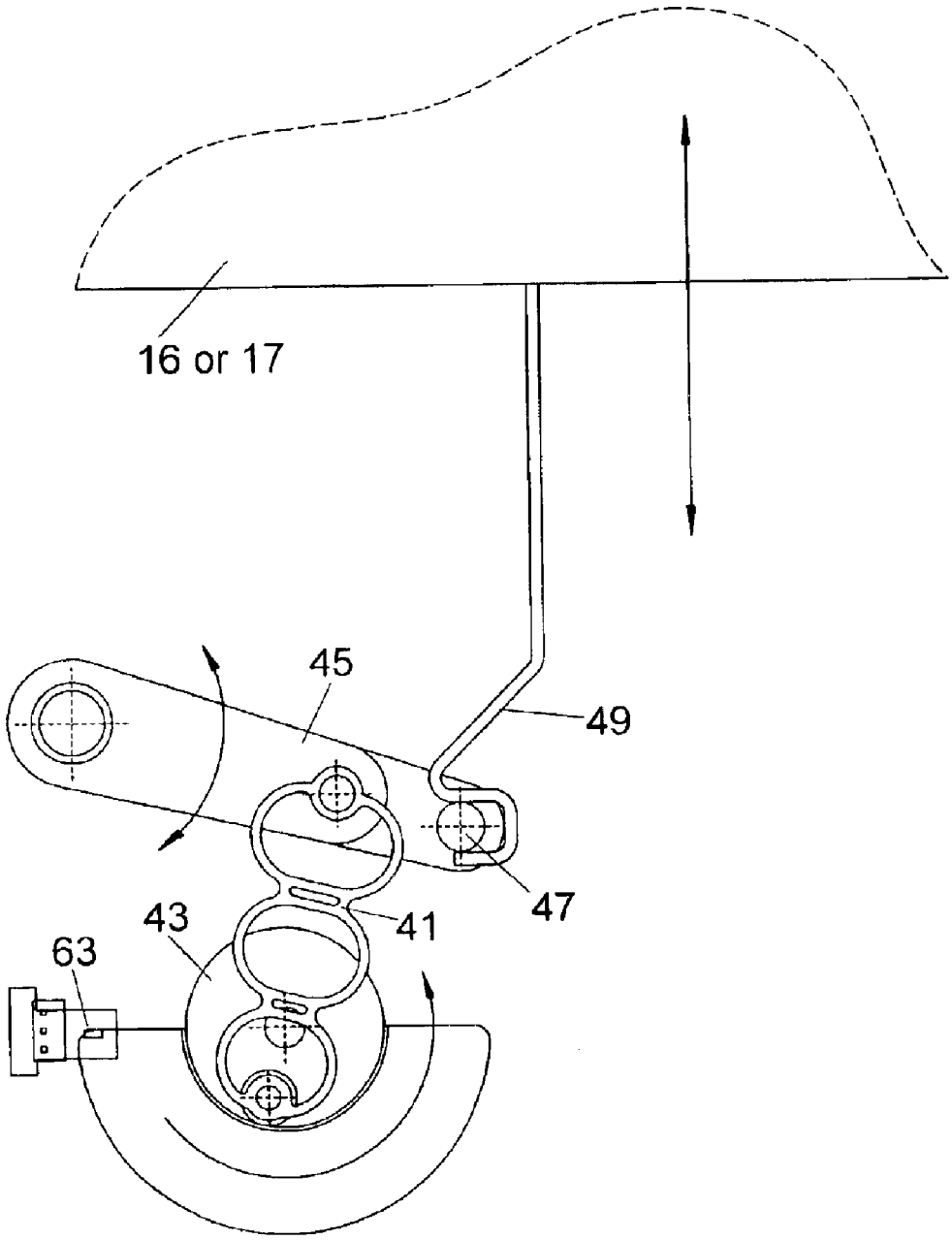
FIG. 3 is a top view in detail on a mechanism for creating stepped stacks according to an embodiment of the present invention.

FIG. 3 shows a mechanism for forming stepped stacks in the apparatus 1 of FIG. 1. The depositing device 15 is equipped with this mechanism for forming the stepped stacks. Hereto, the depositing platforms 16 and 17 move horizontally in a direction perpendicular to the feed direction between two offset positions. The depositing platform is moved to its two offset positions by an electric motor (not shown) coupled to an ordinary crank mechanism for converting the rotary movement of the electric motor into a reciprocating movement. A crank 43 is mounted on the drive shaft of the electric motor and is pivotally connected to one end of a connecting member 41. The connecting member 41 is shaped as three superposed rings, thus creating a longitudinal flexibility that allows it to function as a resilient member. The connecting member 41 is on its other end pivotally connected to a lever 45. The lever 45 is provided with a pivot rod 47 at its free end that is engaged by a hook shaped rod 49. The hook shaped rod 49 is connected to each of the depositing platforms 16 and 17. The pivot rod 47 extends upwardly along the full lifting height of the depositing platforms 16 and 17. The hook shaped rods 49 slide along the pivot rod 47 when the depositing platforms 16 and 17 move vertically. In this example, half a revolution of the electric motor corresponds to a movement from one offset position to another. The position of the crank 43 is optically detected by a sensor 63. The signal of the sensor 63 is sent to the control device 8. The control device 8 in turn signals to stop the movement, when or shortly before, an offset position has been reached.

Figure 4:
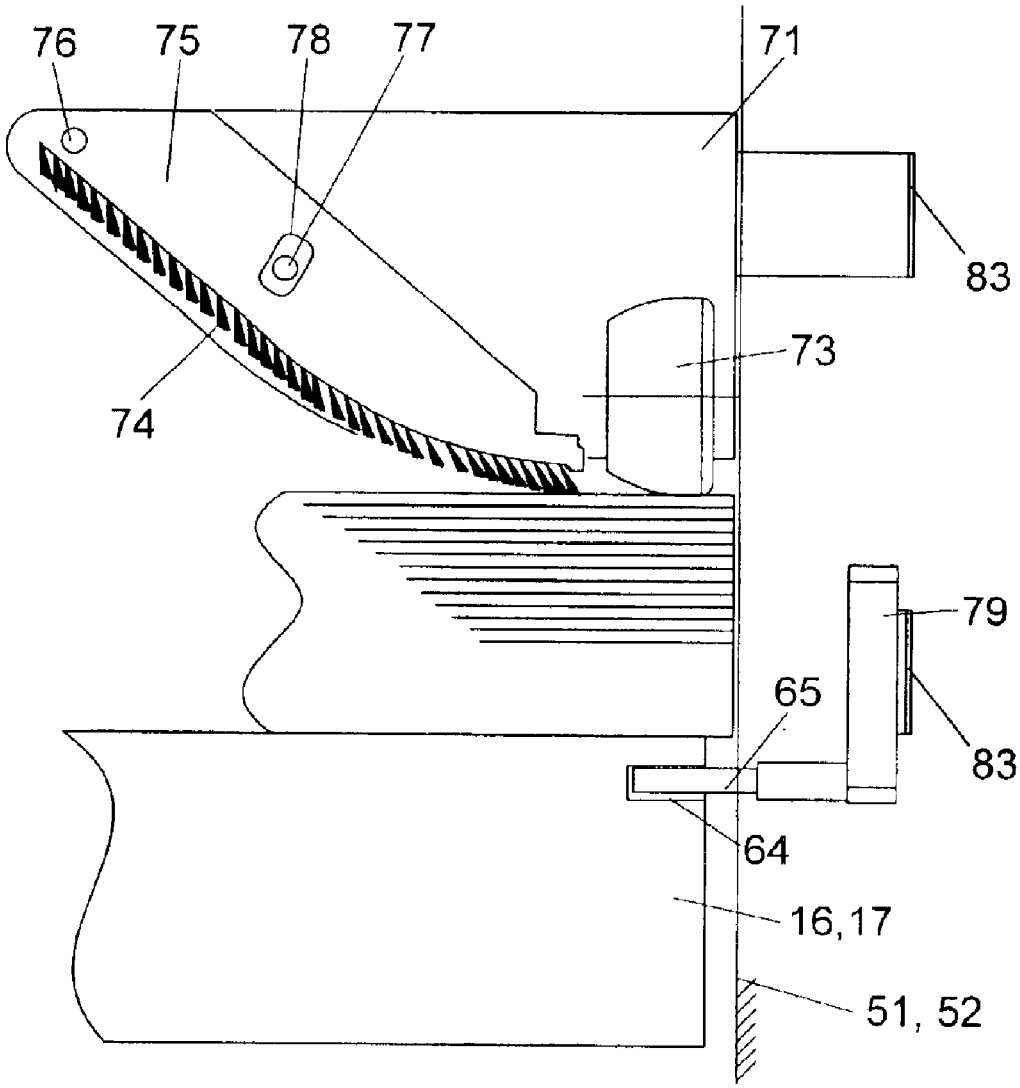
FIG. 4 is a view in detail on a sheet catcher according to an embodiment of the present invention.
Figure 5:
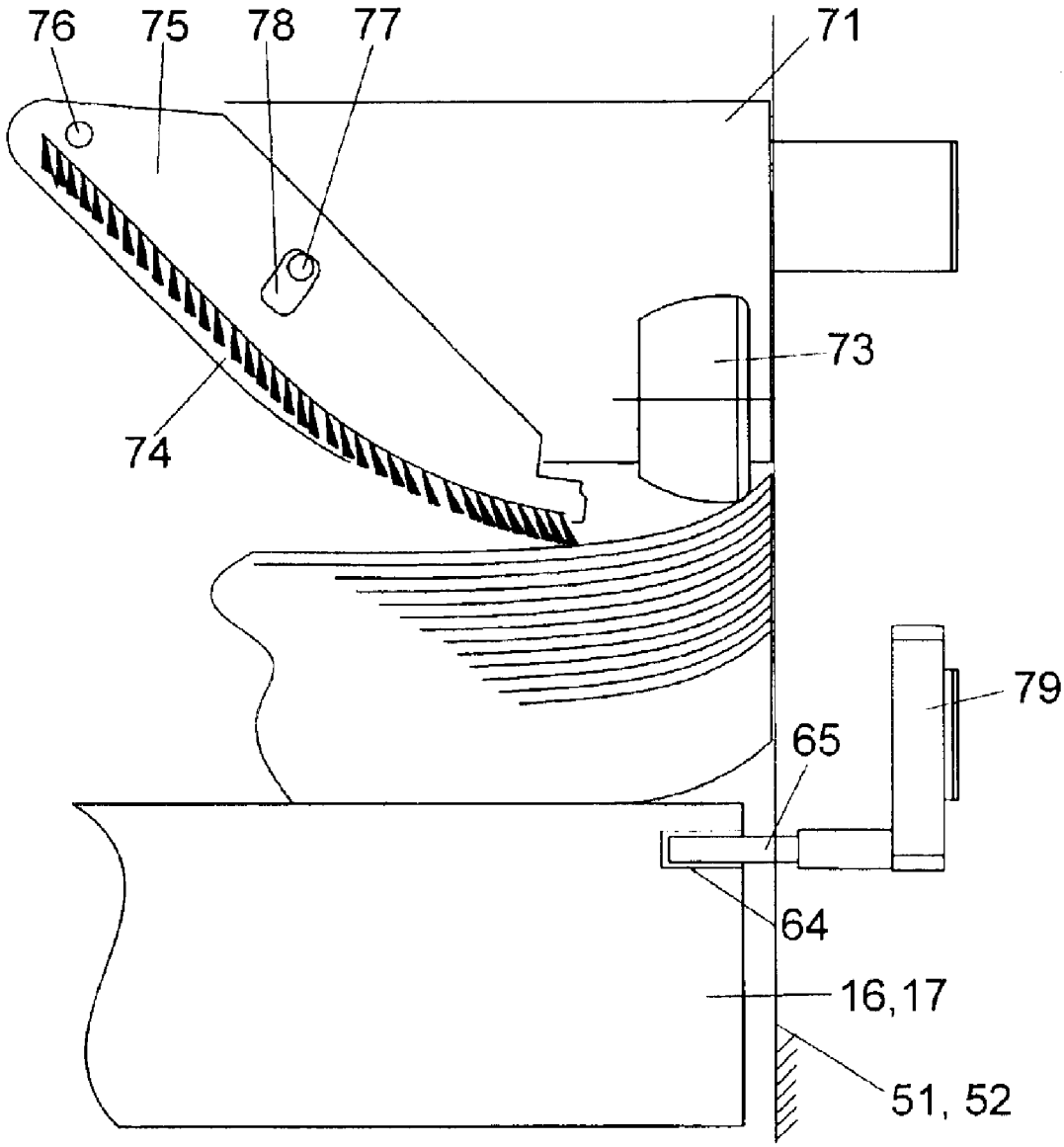
FIG. 5 is a view in detail on a sheet catcher when the stack is curled up against the registration barrier.

Each depositing platform 16,17, shown in detail in FIGS. 4 and 5, is provided with two sheet catchers 71 (only one catcher shown). The sheet catchers 71 are passively movable upwards and downwards along the guide rails 21 and 22 and rest with their weight on the corresponding depositing platform 16, 17, or on a stack of sheets on the corresponding depositing platform 16,17. A major part of the weight of the sheet catchers 71 rests on the stacked sheets/depositing surface through a roller 73. The roller 73 allows movement of the sheets relative to the sheet catchers 71 in a direction substantially perpendicular to the feed direction of the incoming sheets without applying a lateral force to the stacked sheets. This insures that the integrity of the stacked sheets remains undisturbed as the depositing platform moves laterally to offset successive sets of sheets from one another as explained with reference to FIG. 3. The rollers 73 are preferably shaped as a spherical segment or as a conical frustum for providing a sloping surface guiding the leading edge of incoming sheets under the rollers 73. But other suitable shapes may be used for the rollers 73.

The sheet catchers 71 are provided with a sloping surface to form a throat for trapping the leading edge of sheets fed onto the corresponding depositing platform 16,17. The sheets are fed with a high velocity towards the sheet catchers 71. This causes the sheet to be forced under the sheet catchers 71 and the sheet catchers 71 to be elevated.

A tongue 75 is pivotally suspended from a pivot axis 76 placed towards the tip of each of the sheet catchers 71. The freely movable end of the tongue 75 rests on the stacked sheets or on the corresponding depositing platform 16,17. Alternatively, the tongue 75 may be resiliently suspended from the sheet catcher 71. The rotational movement of the tongue 75 is limited by a pin 77 fixed to the corresponding sheet catcher and protruding into an aperture 78 in the tongue 75.

The sheet engagement surface of the tongue 75 is similarly sloped as the sheet catcher 71, and preferably slightly curved. The sheet engaging surface of the tongue 75 protrudes from the sheet engaging surface of the sheet catcher 71 so as to engage the leading edge of incoming sheets. The sheet catchers 71 and their tongues 75 guide the leading edge of the incoming sheet down towards the corresponding depositing platform 16,17 or the stack on the corresponding depositing platform 16,17 until it abuts with the registration barrier (guide rails) 21,22.

The sheet engagement surface of each tongue 75 is covered with a fabric 74 that has a low friction coefficient in one direction and a high friction coefficient in the opposite direction. The fabric 74 is arranged on the tongue 75 such that the incoming sheets will be exposed to the low friction coefficient in the feed direction and to the high friction coefficient in the opposite direction. The fabric 74 preferred for use with the invention has sloping bristles in a pile fabric, but other types of the fabric 74 may be used. The pile fabric 74 which is preferred to use on the contact surface of the tongue 75 is produced by nylons strings woven through a cotton backing to provide the intended front of the fabric. Nylon string extends between stitch apertures which are double the pile length required. These string extends are then cut to produce the piles and these are "panned" which is the application of a heated surface to the piles in one sense to produce a slant. As the piles have the same slant, the friction coefficient in the slant direction is substantially lower than the friction coefficient in the direction opposite to the slant.

The fabric 74 is placed on each tongue 75 with the slant in the paper feed direction. As the sheets are fed with high velocity, they may tend to bounce back from the depositing registration barrier after they abut with the registration barrier which is in this embodiment formed by surfaces 51 and 52 of the two guide rails 21 and 22. The high friction coefficient of the felt fabric in the direction opposite to the feed direction ensures that the sheets do not bounce back even if they abut with the registration barrier 21,22 with some velocity.

The sheets stacked on the depositing platform 16, 17 tend sometimes to curl up against the registration barrier 21, 22 as shown in FIG. 5. The curled up stack pushes the sheet catchers 71 further up and thus the throat is widened. In conventional sheet catchers, this will create a throat that is too wide to apply sufficient frictional force to prevent the sheets from bouncing back from the registration barrier. Because the tongue 75 is freely movable, its sheet engaging surface rests on the top of the stacked sheets, and will thus also be in contact with the leading edge of incoming sheets when the stacked sheets are curled up against the registration barrier 21,22 so as to minimize or eliminate the curling of the stack.

As shown in FIG. 6 through FIG. 10, the sheet depositing device 15 is provided with a sensor arrangement for detecting the positions of the depositing platforms 16 and 17 and the sheet catchers 71, as shown in FIG. 2. The sensor arrangement comprises an array of active elements 80 that may be arranged within the guide rails 21 and 22 for better protection against influences from outside. In a first embodiment shown in FIGS. 6 and 7, the sensor arrangement operates by capacitive detection. The array of active elements 80 is formed by regularly spaced conductive fields 81. The pitch between the conductive fields 81 depends on the required measuring accuracy. In the exemplary arrangement, a pitch of 5 mm or less proves satisfactory. A non-conductive area is provided between two consecutive conductive fields 81. A strip of conductive material 82 extends in parallel to the array of conductive fields 81. The array of active elements 80 (e.g., the conductive fields 81) can, e.g., be manufactured on a print board 85. The print board 85 is placed inside the guide rail 21.

Each of the upper and lower depositing platforms 16 and 17 and the sheet catchers 71 are provided with a passive element of the sensor arrangement in the form of a conductive plate 83. Each conductive plate 83 is arranged such that its horizontal extension is sufficient to cover substantially one conductive field 81 and the corresponding portion of the conductive strip 82. The vertical extent of the conductive plates 83 determines the reliability and the resolution of the measured value. A vertical dimension of twice the pitch between the conductive fields 81 proved to give satisfactory results. The thickness of the conductive plates 83 may be chosen to be very small, as long as the plates 83 are good conductors. The conductive plates 83 are guided in the guide rail 21.

The conductive plates 83 on the sheet catchers 71 are each directly attached to a member of the corresponding sheet catcher that protrudes into the guide rail 21. The conductive plates 83 that move in unison with the depositing platforms 16 and 17 are each attached to a carrier member 79 for the depositing platform (FIG. 4). Each carrier member 79 is guided in the guide rail 21. A pin 65 extends from each carrier member 79 into a nut 64 in the respective depositing platform 16,17. The laterally extending nut 64 allows the corresponding depositing platform 16,17 to move laterally for creating stepped stacks as described above. When the conductive plate 83 moves up or down with the respective depositing platform 16,17 or sheet catcher 71, it moves at a short distance, for instance 0.2 mm, over the conductive strip 82 and alternately over the conductive fields 81 and non-conductive areas between the conductive fields 81.

Figure 6:
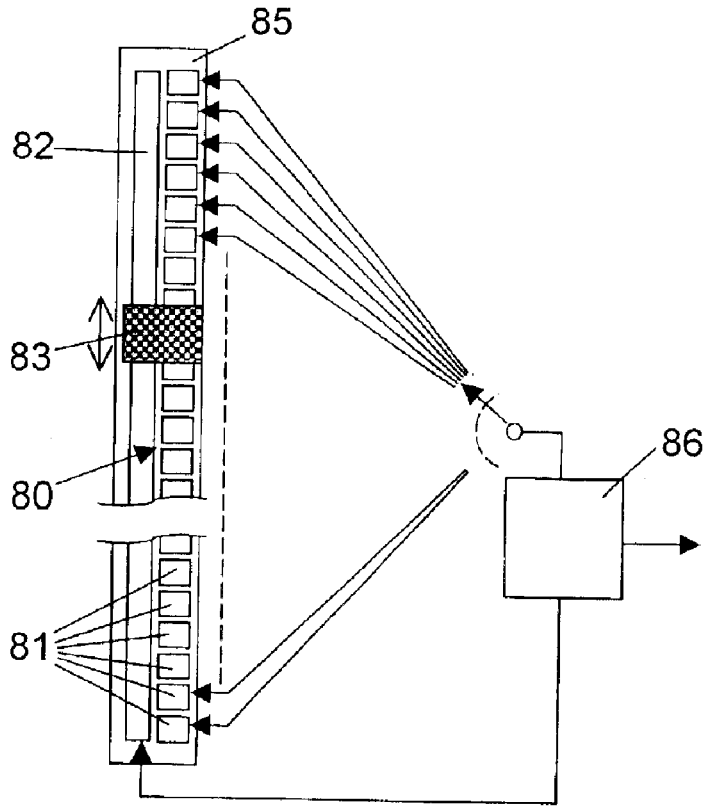
FIG. 6 shows a sensor arrangement according to a first embodiment of the present invention.
Figure 7:
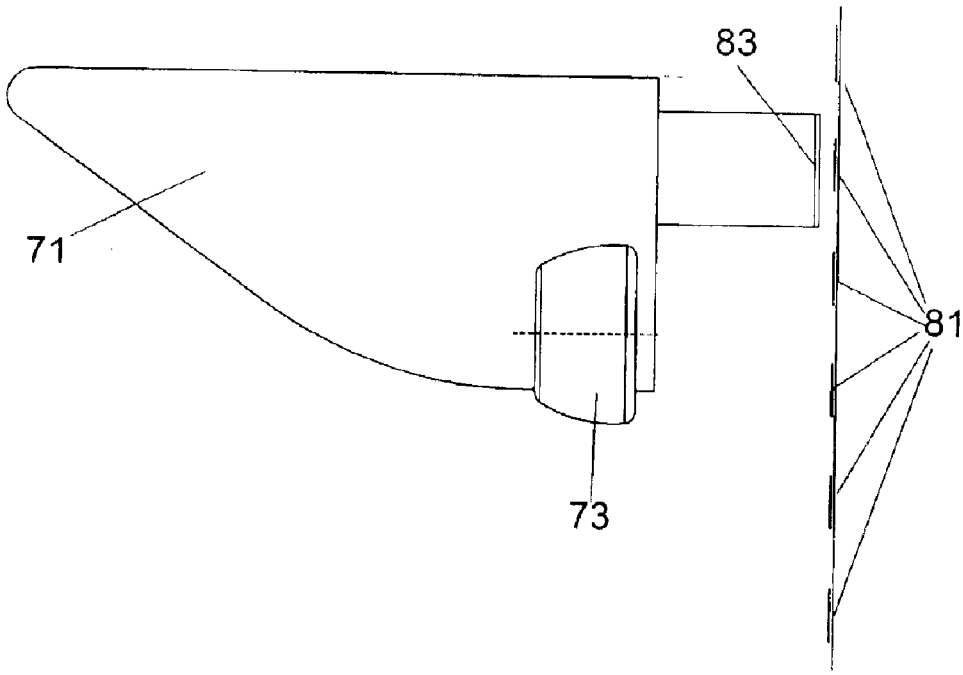
FIG. 7 shows a detail of the sensor arrangement in FIG. 6.

A sub-control unit 86 measures the electrical capacity between each of the conductive fields 81 and the conductive strip 82. As shown in FIGS. 6 and 7, when the conductive plate 83 covers a conductive field 81 and a corresponding portion of the conductive strip 82, the electrical capacity associated with that specific conductive field is much larger than the capacity associated with a non-covered conductive field. The sub control unit 86 measures the electrical capacity associated each conductive field 81 and converts the signals from the sensor array 80 to a position signal which is sent to the control device 8. Through interpolation, the position resolution may easily be increased by a factor of 5 compared to the pitch of the conductive fields.

Alternatively, the strip of conductive material 82 may be replaced by a second array of conductive fields extending in parallel with the first array of conductive fields 81. In this embodiment, the sub control unit 86 measures the capacities of the pairs of conductive fields from the arrays 81 and 82, respectively.

Figure 8:
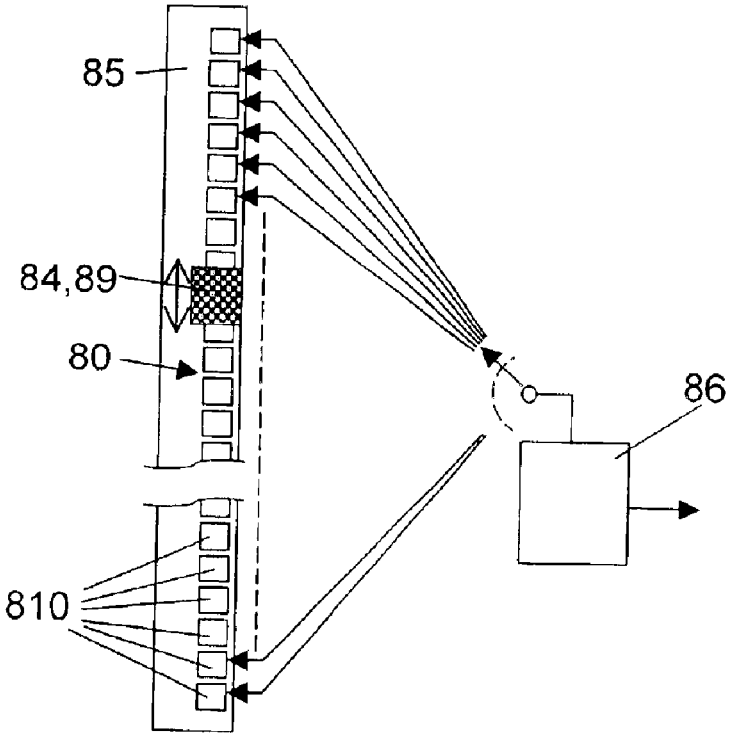
FIG. 8 shows a sensor arrangement according to a second embodiment of the present invention.
Figure 9:
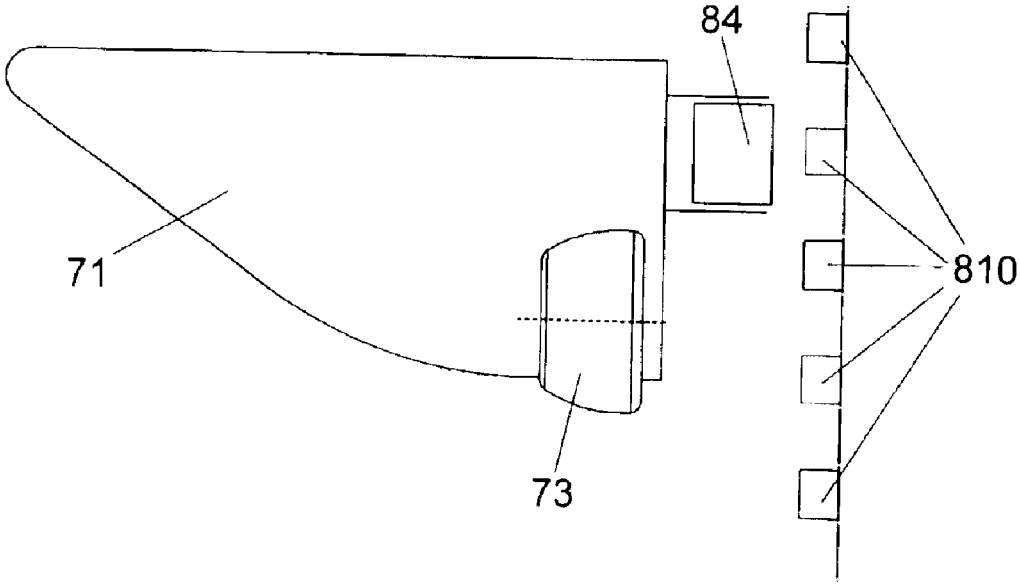
FIG. 9 shows a detail of the sensor arrangement in accordance with the second embodiment.

In a second embodiment shown in FIGS. 8 and 9, the sensor arrangement operates with the Hall effect. The array of active elements 80 is composed of an array of regularly spaced Hall sensors 810, e.g., on the board 85. Each of the upper and lower depositing platforms 16 and 17 and the sheet catchers 71 are provided with a passive element of the sensor arrangement in the form a magnet 84, instead of the plate 83 in the first embodiment. When the magnet 84 moves up or down with the respective depositing platform 16,17 or sheet catcher 71, it moves at a short distance over the Hall sensors 810. In the sub-control unit 86, the signals from the Hall sensors 810 are converted to positional signals and sent to the control device 8.

The configuration of magnets and Hall sensors is chosen so that at least one and at the most two Hall sensors are activated by a magnet in any relative position of the magnet. In this way, the actual position resolution is greater than the mutual distance of the Hall sensors through the use of interpolation. For example, the mutual distance of the sensors is chosen as 10 mm and the distance of the magnets and the sensor array is 3 mm. Magnets used have a field strength at the position of the sensor array of 70 Gauss at a distance of 9 mm from the heart of the magnet. This allows to determine the linear position of the magnet with a resolution of at least 5 mm (position of the sensor or position halfway between two sensors), and even better if a more sophisticated interpolation algorithm is used.

The sheet catchers 71 will always rest onto the stack. The positions of the sheet catchers 71 and the depositing platforms 16 and 17 are known. Thus, the distance between the depositing platform 16,17 and the sheet catcher 71 can be used to determine the stack height. This information is used by the control device 8 to determine when a depositing platform 16,17 is full, e.g. to change to the other or different depositing platform 16,17, or when both depositing platforms 16 and 17 are full, to issue an alarm that the stacking device needs to be emptied.

Figure 10:
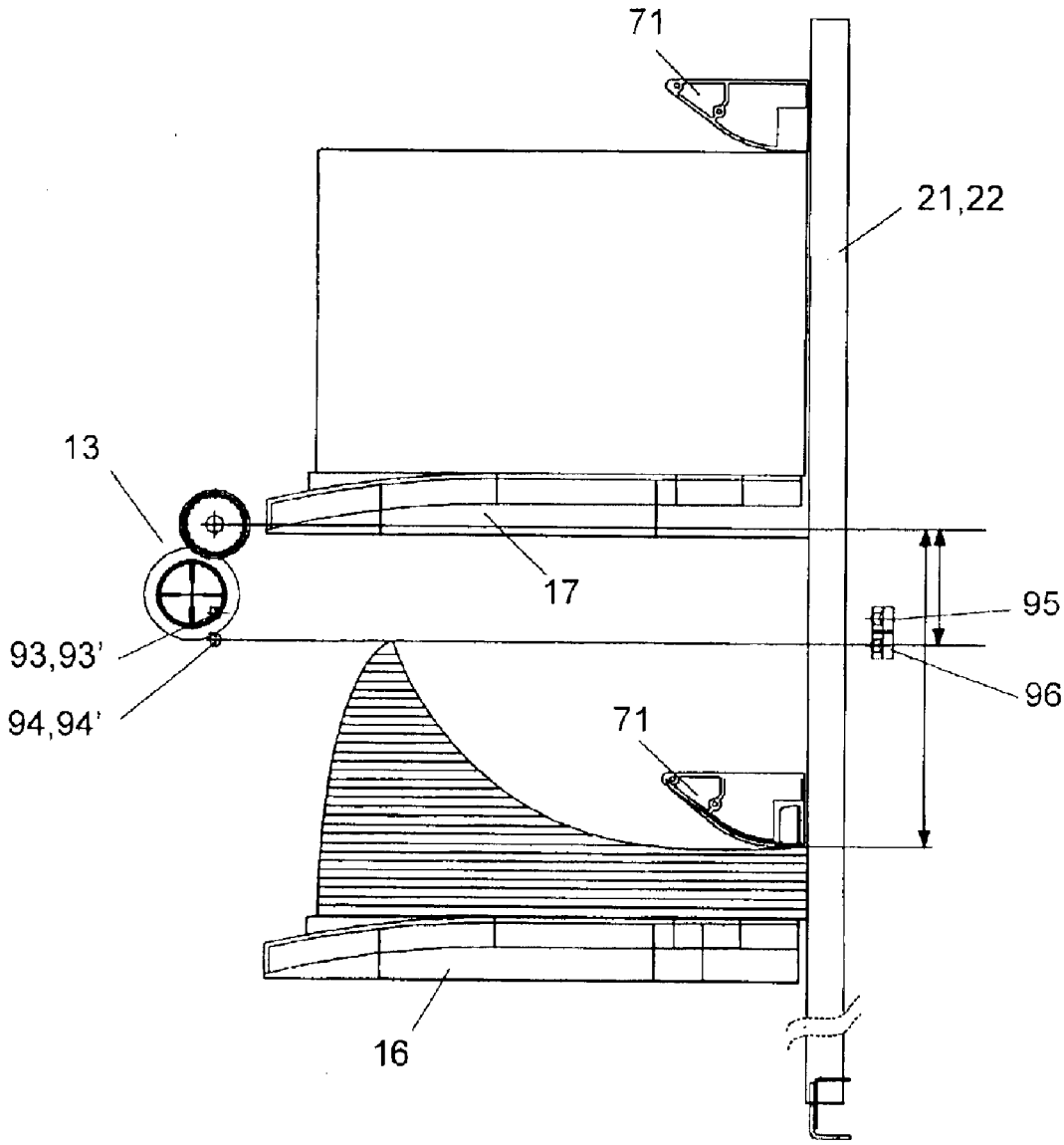
FIG. 10 is a side view in detail on the sheet depositing device illustrating height sensors and curl of the stack in the feed side.

Height detectors as shown in FIG. 10 ensure that the upper edge of a stack of deposited sheets on the active depositing platform 16,17 is always at the correct height to receive a new sheet from the discharge roller pair 13 by adjusting the position of the depositing platform 16,17. The height detectors are formed by two superposed sensors. One sensor comprises a pair of LEDs 93 and 93' and a single photocell 95, and the other sensor comprises a pair of LEDs 94 and 94' and a single photocell 96. Other numbers of photocells and/or LEDs may be contemplated, e.g. one photocell for each LED, or a single photocell for all four LEDs (that would then be operated in a phase-shifted pulsated manner). The pair of LEDs 93 and 93' (94 and 94') of the respective sensor direct a substantially horizontal light bundle from the feed side of the stack towards the respective photocell 95 (96) at the registration barrier side of the stack. The LEDs 93 and 93' (94 and 94') in one pair are spaced laterally apart. The respective photocell 95 (96) is arranged in the lateral midpoint of the stack. The LEDs 93 and 93' (94 and 94') therefore direct two light beams diagonally over the stack towards each photocell 95 (96). The output of the photocell 95 (96) is active only when it receives light from both LEDs 93 and 93' (94 and 94').

The photocells 95 and 96 are connected to the control device 8. The LEDs 94 and 94' and first photocell 96 are arranged at the minimum depositing height, whereas the LEDs 93 and 93' and second photocell 95 are arranged at the maximum depositing height. When the output of the first photocell 96 is active, the control device 8 powers the respective DC motor to raise the active depositing platform 16,17 until the first photocell 96 becomes inactive. When the second photocell 95 becomes inactive, the control device 8 powers the respective DC motor to lower the active depositing platform 16,17 until the second photocell 95 becomes active. When the depositing platform 16,17 is in the correct position, the output of the first photocell 96 should be inactive and the output of the second photocell 95 should be active.

While feeding a sheet onto the stack, the height detectors are deactivated for a short period because the incoming sheet will obstruct the LEDs 93,93',94,94'.

In one example, the stacked sheets sometimes tend to form a curl on the feed side of the stack, which is aggravated by, e.g., staples which make the stack grow faster on the staple side. The effect is illustrated in FIG. 10. The height detectors ensure that the active depositing platform 16,17 will be lowered to compensate for the curl, to ensure that the sheets fed by the discharge roller pair 13 do not hit the side of the stack. This may lead however to a situation, e.g. when the curl on the feed side is large, in which the sheet catchers 71 are positioned too low with respect to the discharge roller pair 13, and the leading edge of the incoming sheets will not be caught under the sheet catchers 17, but instead pass above the sheet catchers 71. In this situation the control over the stacking process may be completely lost. The control device 8 compares therefore the height of the sheet catchers 71 with the height of the feed roller pair 13, and if the height difference between the sheet catchers 71 and the feed roller pair 13 exceeds a preset threshold, the feeding process is stopped and an alarm is set. This provides a more effective and comprehensive sheet processing system.

Although the present invention has been described by an embodiment with two depositing platforms and two guide rails, it is clear for those skilled in the art, that this is merely an example of a preferred embodiment of the present invention. It is, e.g., possible to use only one guide rail and one platform, or to use more than two guide rails and/or more than two platforms. Further, the features from different embodiments may be combined. For instance, in a sheet processing apparatus, one sheet depositing platform and/or sheet catcher may use an array of conductive fields and a conductive plate in a sensor arrangement, whereas a different sheet depositing platform and/or sheet catcher may use an array of Hall sensors and a magnet in a sensor arrangement to detect the position of the platform and/or sheet catcher.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet depositing device for a sheet processing apparatus, the device comprising:

a feeding section for sequentially feeding sheets or sets of sheets from the sheet processing apparatus;

at least one sheet stacking element movable along at least one guide, for facilitating depositing the sheets or sets of sheets fed by said feeding section in said sheet depositing device; and a sensor arrangement for detecting the position of a corresponding sheet stacking element along said guide, said sensor arrangement including a stationary linear array of active elements and a passive element moving in unison with said corresponding sheet stacking element, wherein said active and passive elements interact through the use of electric or magnetic fields.

2. The device according to claim 1, wherein said active elements are positioned closely together in the array.

3. The device according to claim 1, further comprising:

a position calculation unit for calculating a position of the passive element of the sensor arrangement on the basis of interpolation of readings of the active elements of the array.

4. The device according to claim 1, wherein said array of active elements comprises an array of conductive fields arranged in parallel to a conductive strip or a second array of conductive fields, and said passive element comprises a conductive plate.

5. The device according to claim 1, wherein said array of active elements comprises an array of Hall-effect sensors, and said passive element comprises a magnet.

6. The device according to claim 1, wherein said sheet stacking element comprises one or more superposed depositing platforms for depositing thereon sheets or sets of sheets fed by said feeding section and being movable along said guide, and said passive element corresponds to one of the depositing platforms and moves in unison with said corresponding depositing platform.

7. The device according to claim 1, wherein said sheet stacking element comprises one or more sheet catchers movable along said guide, and said passive element corresponds to one of the sheet catchers and moves in unison with said corresponding sheet catcher.

8. The device according to claim 1, wherein said stationary array of active elements is affixed to said guide.

9. The device according to claim 8, wherein said stationary array of active elements is placed inside said guide.

10. The device according to claim 8, wherein said sheet stacking element includes a depositing platform for depositing thereon sheets fed by said feeding sections and said stationary array of active elements extends over the lifting height of said depositing platform.

11. A sheet depositing device comprising:

a guide;

a sheet stacking unit to move along the guide and to deposit sheets thereon; and a magnetic or electric sensor arrangement to detect a position of the sheet stacking unit along the guide using magnetic or electric fields, respectively, the sensor arrangement including an array of active elements and a passive element moving in unison with the sheet stacking unit.

12. The device according to claim 11, wherein the array of active elements includes an array of conductive fields arranged in parallel to a conductive strip or a second array of conductive fields, and the passive element includes a conductive plate.

13. The device according to claim 11 wherein the array of active elements includes an array of Hall-effect sensors, and the passive element includes a magnet.

14. The device according to claim 11, wherein the array of active elements is affixed to the guide.

15. The device according to claim 11, wherein the sheet stacking unit includes one or more superposed depositing platforms movable along the guide, and the passive element corresponds to one of the depositing platforms and moves in unison with the corresponding depositing platform.

16. The device according to claims 11, wherein the sheet stacking unit includes one or more sheet catchers movable along the guide, and the passive element corresponds to one of the sheet catchers and moves in unison with the corresponding sheet catcher.

* * * * *